US006418972B2

(12) United States Patent
Krumm et al.

(10) Patent No.: US 6,418,972 B2
(45) Date of Patent: Jul. 16, 2002

(54) ROTARY DRIVE WITH DIRECT DRIVE ELECTROMAGNETIC MOTOR FOR A REED SLAY OF A LOOM

(75) Inventors: Valentin Krumm, Hergensweiler; Heinz-Peter Loehr, Maria-Thann; Hans-Joachim Holz, Lindau, all of (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 09/847,529

(22) Filed: May 2, 2001

(30) Foreign Application Priority Data

May 3, 2000 (DE) ..... 100 21 520

(51) Int. Cl.[7] ..... D03D 49/60
(52) U.S. Cl. ..... 139/188 R; 139/25
(58) Field of Search ..... 139/188 R, 25

(56) References Cited

U.S. PATENT DOCUMENTS 5,058,628 A * 10/1991 Spiller et al. ..... 139/25
5,499,662 A * 3/1996 Vogel et al. ..... 139/26
6,065,503 A * 5/2000 Berktold et al. ..... 139/26

FOREIGN PATENT DOCUMENTS

| | | |
|---|---|---|
| DE | 19821094 | 7/1999 |
| EP | 0440579 | 8/1991 |
| EP | 0892100 | 1/1999 |

* cited by examiner

*Primary Examiner*—Andy Falik
(74) *Attorney, Agent, or Firm*—W. F. Fasse; W. G. Fasse

(57) ABSTRACT

A reed in a loom is driven or oscillated back and forth to perform the beat-up motion by a direct reed drive that avoids using the main loom drive for operating the reed. The direct drive is an electromagnetic motor which uses as one of its components a reed support shaft (4) either as a rotor or as a stator. The reed support shaft acting as a rotor carries a reed slay which mounts the reed to the rotor. When the reed support shaft acts as a stator, the reed slay is mounted to separate rotor elements. In both instances the reed support shaft is part of a rotary or linear electromagnetic direct drive motor construction.

20 Claims, 5 Drawing Sheets

ROTARY DRIVE WITH DIRECT DRIVE ELECTROMAGNETIC MOTOR FOR A REED SLAY OF A LOOM

PRIORITY CLAIM

This application is based on and claims the priority under 35 U.S.C. §119 of German Patent Application 100 21 520.3, filed on May 3, 2000, the entire disclosure of which is incorporated herein by reference.

FIELD OF THE INVENTION

The invention relates to a direct drive of a reed in a loom for performing the back and forth beat-up motion. The reed to be driven is mounted on a reed slay which in turn is oscillatable back and forth about a rotational longitudinal axis of a reed support shaft.

BACKGROUND INFORMATION

There are two types of reed drive. The first reed drive type derives power from the main loom drive. The second reed drive type has its own power source. When the reed driving power is derived from the main loom drive, suitable drive transmission components are required, particularly gear drives that connect the reed support shaft to the main loom drive shaft. In such drives the reed is mounted to the reed support shaft by at least one reed slay. The drive transmission between the main loom drive shaft and the reed support shaft constitutes a rigid coupling. Such rigid coupling in looms which otherwise are representing the most recent state of the art, forms a bottleneck, so to speak, in certain respects because a rigid coupling is not amenable to a rapid, inexpensive change of the tilting angle or angle range of the reed slay and the reed. A rather costly and time consuming effort and expense is necessary when such change in the angle of the beat-up motion is required, for example when changing the loom from weaving smooth fabric to weaving terry cloth and vice versa.

European Patent Publication EP 0,892,100 A1 discloses an apparatus that is capable of changing the angle range of the beat-up motion. However, the extra effort and expense is substantial. The drive of the slay is derived from the main drive of the loom. The slay is mounted for a tiltable oscillating back and forth movement for performing the basic beat-up motion. The main loom drive supplies the power that is transmitted through a transmission (5) to the slay for the basic oscillating motion about a tilting axis. The reed position is adjustable, e.g. the beat-up position is adjustable by a separate servomotor 11. Such adjustment of the beat-up position is desirable, for example for the production of terry cloth. The separate servo-motor (11) and its worm gear transmission (12, 13) constitute an extra effort and expense even if the angular oscillating motion of the reed is derived from the main loom drive.

The second type of reed drive for the oscillating motion is disclosed in European Patent Publication EP 0,440,579 B1 which describes a reed drive that is independent of the main loom drive. The drive system for the reed comprises means for transmitting the variable r.p.m. of an electric motor onto the shaft that carries the slay which in turn carries the reed. The drive motor of this independent drive system requires a closed loop control for varying the motor r.p.m. The transmission of the drive power of the electric motor to the reed support shaft requires drive transmissions such as at least one coupling gear or an eccentric cam drive or a belt drive. All these components require a respective installation space within the loom. Moreover, drive systems of this type are rather prone to wear and tear and hence the maintenance effort and expense is substantial.

German Patent Publication 198 21 094 A1 discloses a loom with a reed that is driven by an electromagnetic linear motor that imposes a controlled back and forth oscillating motion on the reed. For this purpose the slay is connected to the linear motor by an articulated connecting rod, whereby the rod and an electromagnet forms the electromagnetic linear motor for the slay or the reed. Such a drive makes it possible to adjust the beat-up angle of the slay in any desired position independently of the main loom drive. Another advantage is seen in that the beat-up frequency can be adjusted to any particular requirement in a simple manner. However, these advantages have to be considered in the light of substantial disadvantages. The articulated connecting rod constitutes a structural element that has critical characteristics because the articulated connection of the connecting rod to the slay requires a bearing that is exposed to a substantial wear and tear. As a result, maintenance work needs to be done frequently which reduces the productivity of a loom equipped with such an external linear motor. Moreover, if the maintenance work is not performed often enough, a substantial play may develop in the articulating bearing so that the quality of the individual beat-up motions becomes different over time. Such differences in the beat-up motion are quite noticeable in the finished fabric, either in the form of insufficiently dense fabric spots or in extremely dense fabric spots amounting even to stripes in the finished fabric. Another disadvantage of the construction with an external linear motor is seen in that the linear motor must be positioned outside of the slay of the loom, thereby not only increasing space requirements, but also requiring a relatively stiff construction of the connector rod and the stationary component of the linear motor in order to achieve an oscillating motion of the slay and thus of the reed. Another limitation of the external linear motor is seen in that it has its limitations with regard to the high speed capability of modern looms with regard to their r.p.m. and with regard to the weaving width.

OBJECTS OF THE INVENTION

In view of the foregoing it is the aim of the invention to achieve the following objects singly or in combination:

- to provide a rotary drive for a reed or rather for the slay that carries the reed which drive avoids the drawbacks outlined above while simultaneously accommodating the requirements of modern high speed looms without deriving its driving force from the main loom drive;
- to provide a reed drive that is independent of the main loom drive while simultaneously accommodating the performance parameters of modern looms, particularly with regard to high speed r.p.m.s;
- to construct the reed drive with a low mass and which shall not require additional installation space in the loom and so that the drive realizes an oscillating dynamic of the reed that is uniform throughout the weaving process from start to finish so that variations in the fabric density are avoided, particularly start-up faults in the fabric are to be avoided;
- to provide a reed drive that is suitable for weaving smooth fabrics as well as terry cloth fabrics; and
- to permit an adjustment of the oscillating angle and of the beat-up position of the reed to any position within the total oscillating angle of the reed.

SUMMARY OF THE INVENTION

The above objects have been achieved according to the invention in that the reed drive has a direct electromagnetic drive motor into which the reed support shaft is integrated as a motor component. The direct drive electromagnetic motor comprises a rotor and a stator. Either the stator or the rotor is formed by the reed support shaft. In a second embodiment the direct drive motor comprises electromagnetic motor elements that together with the reed support shaft form a linear motor. The linear motor elements are angularly arranged around the reed support shaft to form a circular configuration to convert linear motion components of the linear motor into oscillating reed beat-up motions oscillating back and forth between a rear position and a beat-up position.

If the reed support shaft is constructed as a stator, the shaft is mounted in a rigid position in the loom frame and an external rotor surrounds the nonrotatable shaft, whereby the external rotor carries at least one slay which in turn carries the reed.

The direct drive motor in another embodiment is constructed as an electric servomotor or as a circularly configured electromagnetic linear motor. The linear motor also comprises two embodiments, either with the reed support shaft stationary or with the reed support shaft forming the movable component of the linear motor.

With the direct drive constructions according to the invention it is possible to adjust the basic position of the reed angularly to a rotational angle $\alpha l$ within the outer limits of the total oscillating angle $\alpha 2$ of the reed, whereby the rotational angle $\alpha 1$ is measured relative to the vertical V. The total angular oscillation $\alpha 2$ is also variable, but not relative to the vertical.

In another embodiment of the invention the reed support shaft of the loom forms the rotor of at least one electromagnetic direct drive motor for the reed while the stator is rigidly mounted in the machine frame. The functions of the rotor and stator are merely exchanged relative to each other.

It is preferred to provide more than one direct reed drive. For example if two such drives are provided one drive will be positioned at each end of the reed support shaft. If only one drive is provided, such drive may be positioned anywhere along the length of the reed support shaft within the weaving width of the loom. Further, if more than two drives are provided along the weaving width, these drives may be uniformly spaced. Where more than two drives are provided, it is necessary that the component that forms the stator is provided with a segmental recess within the oscillating angular range of the slay. The use of a plurality of direct drives according to the invention is particularly beneficial for looms having a large weaving width since the respective reed support shafts require a larger torque moment for performing the oscillating back and forth beat-up motion.

The embodiment of the linear motor constituting the reed drive according to the invention has its components and elements arranged in radial or rather angular fashion to form a circular configuration, whereby the reed support shaft constitutes a rigidly mounted structural motor component. However, such rigidly mounted component is still referred to as a "shaft" even though it does not rotate in this particular embodiment. If the shaft is stationary, the slay is mounted on the stationary shaft through a bearing that is rotatable about the longitudinal central axis of the stationary reed support shaft. The slay has a section between the slay root and the mounting bearing, which section is formed as a segment in such a way that permanent magnets forming motor elements are mounted on one axially facing side of the segment surface areas or on both axially, but oppositely facing, segment surface areas. These permanent magnets form, according to the invention, with the slay the secondary or movable portion of the electromagnetic linear motor. The primary portion of the linear motor is formed by electromagnetic coils which are mounted on a fan-shaped coil support that is rigidly mounted to the reed support shaft forming the stator. The coils are mounted in positions that correspond to the positions of the permanent magnets of the secondary portion of the linear motor. In a preferred embodiment the primary and secondary elements of the linear motor positioned as just described form, according to the invention, a disk armature motor.

According to another embodiment of the invention two linear drive motors are used to cooperate in a push-pull manner so that one drive causes the beat-up motion of the reed while the other drive returns the reed into the rear position.

In order to ascertain the instantaneous angular position of the reed support shaft or the reed within a predetermined angular range $\alpha 2$, at least one of the drives is equipped with a signal transmitting synchronous resolver which is connected with the electronic central loom control of the loom to transmit angular position signals to the central loom control.

It is a distinct advantage of the direct reed drives according to the invention that most varied beat-up positions and beat-up forces of the reed can be adjusted relative to the beat-up line of the fabric. A further advantage is seen in that already from the very start of the loom the dynamic of the reed motion is established corresponding to the dynamic that conventionally only develops with a continuous loom operation, whereby from the very start a uniform fabric is produced and so-called start-up faults in the fabric are avoided.

BRIEF DESCRIPTION OF THE DRAWINGS

In order that the invention may be clearly understood, it will now be described in connection with example embodiments, with reference to the accompanying drawings, wherein.

DESCRIPTION OF PREFERRED EXAMPLE EMBODIMENTS AND OF THE BEST MODE OF THE INVENTION

Figure 1:
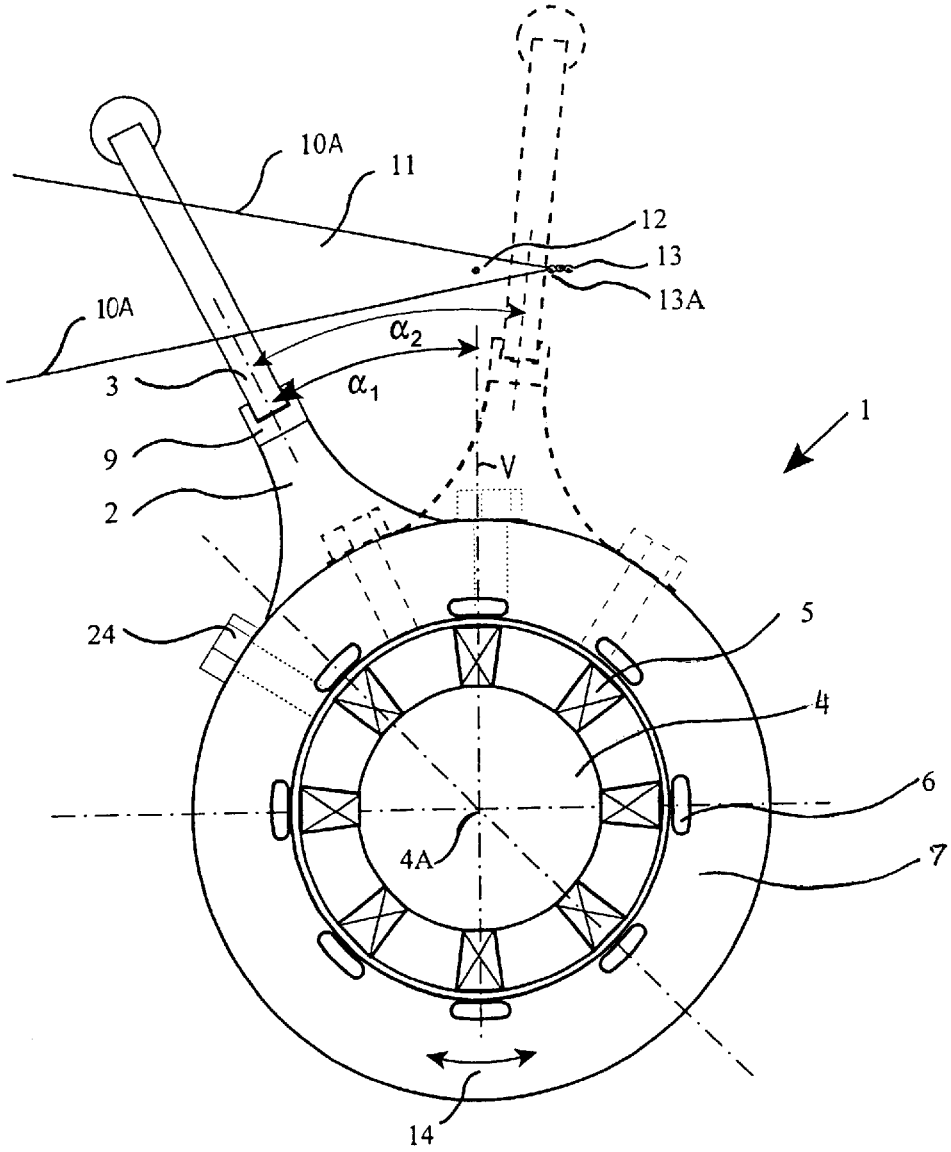
FIG. 1 illustrates a side view in the direction of the longitudinal rotational axis of a direct reed drive according to the invention, wherein the reed support shaft is a stator and the reed carrying slay is a rotor.

FIG. 1 shows an end view of a direct reed drive 1 according to the invention. The loom itself is not shown in FIG. 1. A reed support shaft 4 having a central longitudinal rotational axis 4A according to the invention is rigidly mounted at its ends in a loom frame LF shown in FIG. 4. The shaft 4 is referred to as such even though in the embodiment of FIG. 1 the shaft 4 is stationary and forms the stator. The shaft 4 carries a plurality of electromagnetic coils 5. For example eight coils 5 are shown as elements of an electromagnetic motor forming the drive 1. According to the invention the shaft 4 is a component of the motor drive 1. The shaft 4 with its coils 5 is surrounded by a support or ring 7 equipped with further motor elements in the form of permanent magnets 6, eight of which are provided in or on the ring 7. A reed slay 2 is secured to the rotatable carrier ring 7, for example by screws 24. The reed 3 is secured to the slay in a ridge groove 9 in which the reed is received and rigidly held.

The full line illustration shows the reed 3 in the rear position when the shed 11 formed by the warp thread 10A is open for the insertion of a weft thread 12. Once insertion of the weft thread 12 is completed, the reed 3 is driven to perform the beat-up motion to move the weft thread 12 against the beat-up line 13A to form the fabric 13. At least one weft thread 12 is inserted into each open shed 11.

According to the invention the reed 3 is directly driven by the servomotor formed by the shaft 4, the coils 5 and the magnets 6 carried in the ring 7 for oscillating the reed 3 in the back and forth motion for the beat-up as indicated by the double arrow 14. The ring 7 forms the rotor of the motor drive 1. A bearing or bearings not shown holds the ring 7 centered relative to the central axis 4A.

The reed slay 2 is mounted at an angle al relative to the vertical V and such mounting determines the basic full line end position of the reed 3 as shown in FIG. 1. Starting from the shown base position the oscillation angle $\alpha 2$ can be adjusted according to the invention by a respective control of the direct motor drive 1. Such a variation of the oscillating angle $\alpha 2$ is, for example desirable for the weaving of terry cloth.

Figure 2:
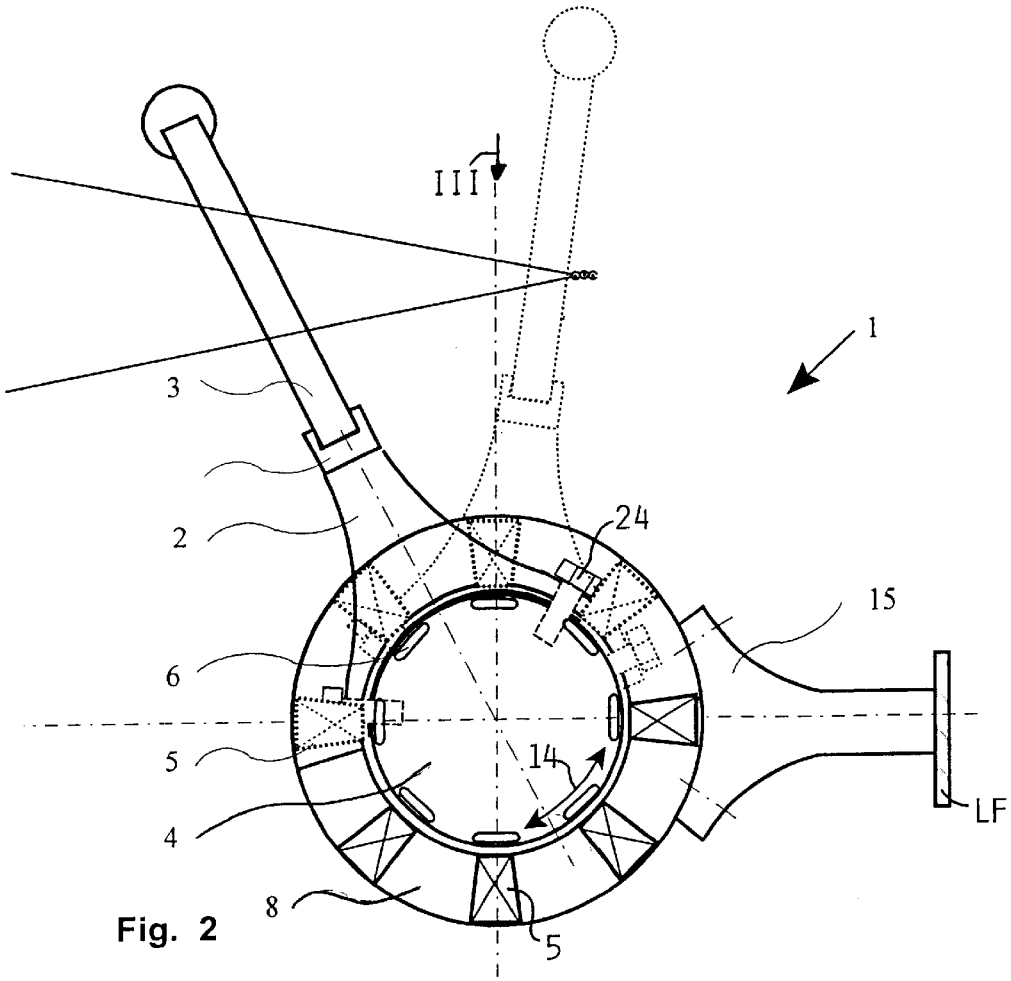
FIG. 2 is a view similar to that of FIG. 1, however illustrating the reed support shaft as a rotor while the reed carrying slay is constructed as a stator mounted to the loom frame.

FIG. 2 shows a view similar to that of FIG. 1, however, now the shaft 4 forms the rotor of the motor. The rotor 4 is oscillated back and forth for the beat-up motion as indicated by the arrow 14. For this purpose the ends of the shaft 4 are rotatably mounted in the loom frame. The rotor shaft 4 carries a plurality of permanent magnets 6 while the magnetic motor coils 5 are mounted in a stator ring 8 which is secured by a mounting 15 secured in the loom frame LF. The coils 5 cooperate with the permanent magnets 6 to form the motor 1.

Figure 3:
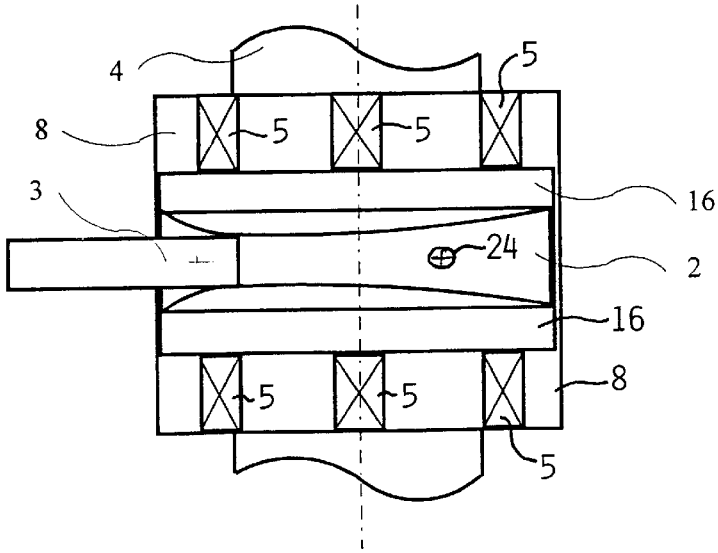
FIG. 3 is a view in the direction of the arrow III in FIG. 2, however omitting the stator mounting.

FIG. 3 is a view in the direction of the arrow III in FIG. 2 and shows the mounting of the reed slay 2 to the angularly oscillatable shaft 4. For this purpose the stator ring 8 has a segmented recess 16 into which the slay 2 fits for connection to the shaft 4 by screws 24. FIG. 3 also shows that coils 5 may be arranged on both sides of the slay 2.

Figure 4:
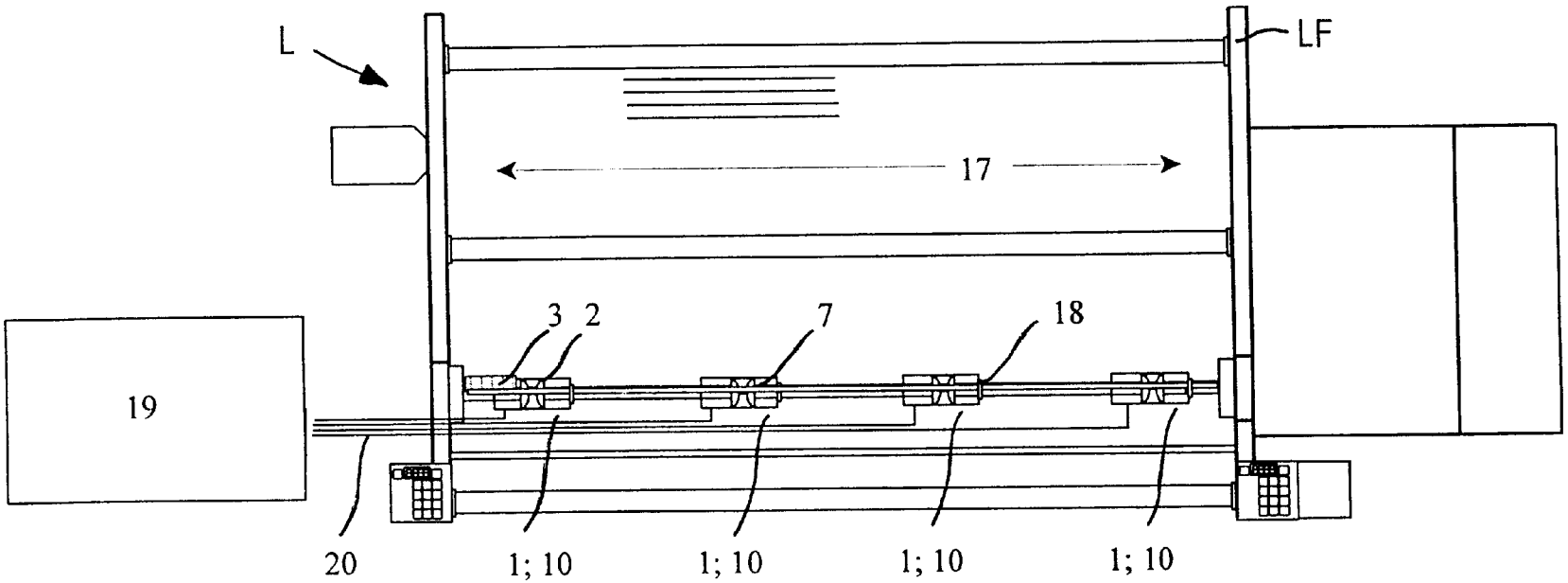
FIG. 4 is a schematic top plan view of a loom equipped with, for example, four electromagnetic direct drive motors arranged on the reed support shaft, whereby each drive is equipped with a synchronous resolver for measuring the angular position of the reed.

FIG. 4 shows a schematic top plan view of a loom equipped with four reed drives 1 or 10 according to the invention. These reed drives 1 or 10 are spaced from each other along the weaving width 17 of the loom L. Preferably one drive is arranged at each end of the weaving width and two more drives are uniformly spaced from one another and from the end drives, especially in a loom with a weaving width exceeding about two meters.

Referring further to FIG. 4 the use of several linear drives 10 and/or several direct rotational drives 1 distributed over the weaving width 17 of the loom L is advantageous, particularly for looms having a large weaving width. Oscillating a reed for a large weaving width requires more torque moment than oscillating a short reed. This torque moment requirement is easily satisfied according to the invention by a plurality of direct reed drives as disclosed herein. It should be noted here, that direct drive motors 1 do not necessarily require the use of a reed slay 2. Rather, it is possible that the motors incorporating the reed support shaft 4 may be positioned at certain locations along the reed support shaft 4 while the reed slay 2 is connected to the shaft at other suitable locations outside the motor.

FIG. 4 further shows that at least one direct drive motor 1 or at least one linear drive motor 10 is combined with a synchronous resolver 18 for providing signal information representing the instantaneous angular position of the inner rotor or of the outer rotor and thus of the reed 3. This angular information signal is transmitted through electrical conductors 20 to the central loom control 19 for further processing and controlling the reversible motion direction of the respective direct reed drive 1.

Figure 5:
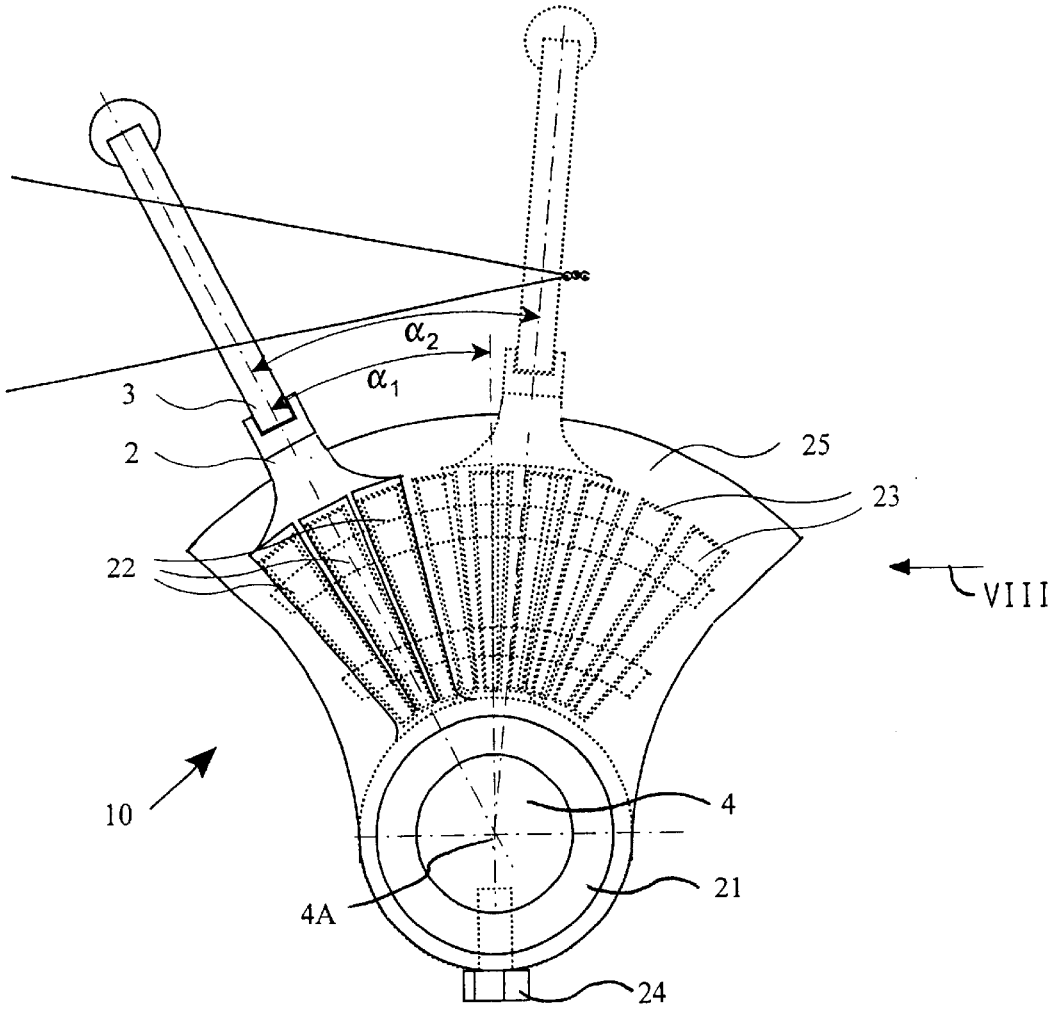
FIG. 5 shows an electromagnetic linear motor constructed according to the invention as a slay drive, whereby the motor elements are arranged angularly to form a circular configuration of the linear motor.

FIG. 5 shows a second embodiment of a direct reed drive motor 10 according to the invention in the form of a linear motor 10 that incorporates the reed support shaft 4 as one of its motor components. The servomotor 1 that incorporates the reed support shaft 4 according to the first embodiment can be replaced by radially or rather circularly or angularly oriented motor elements forming a linear motor 10 with a circular configuration for converting linear motion segments into an oscillating back and forth, essentially angular movement. The reed support shaft 4 is rigidly mounted in the loom frame to form the stator of the motor. The reed slay 2 in this embodiment is connected through a bearing 21 that is rotatable relative to the central longitudinal axis 4A of the reed support shaft 4. More specifically, the slay 2 is connected to the outer race of the bearing 21, the inner race of which is connected to the reed support shaft 4. Motor elements in the form of permanent magnets 22 are secured to the reed slay 2 either on one axially facing side or on both axially facing sides which are geometrically shaped as segments so as to accept a plurality of such permanent magnets 22. These magnets 22 form together with the reed slay 2 the secondary section of the linear motor 10. The primary section of the linear motor 10 is formed by the coils 23 which are angularly distributed and secured to a fan-shaped mounting member 25 rigidly secured to the support shaft 4, for example by screws 24 in a stationary position. The position of the magnets 22 on the side faces of the reed slay 2 and the position of the electromagnetic coils 23 are adjustable relative to each other for obtaining the desired base position of the reed 3 at the angle $\alpha 1$ from the vertical V and the oscillation amplitude as indicated by the angle $\alpha 2$.

Figure 6:
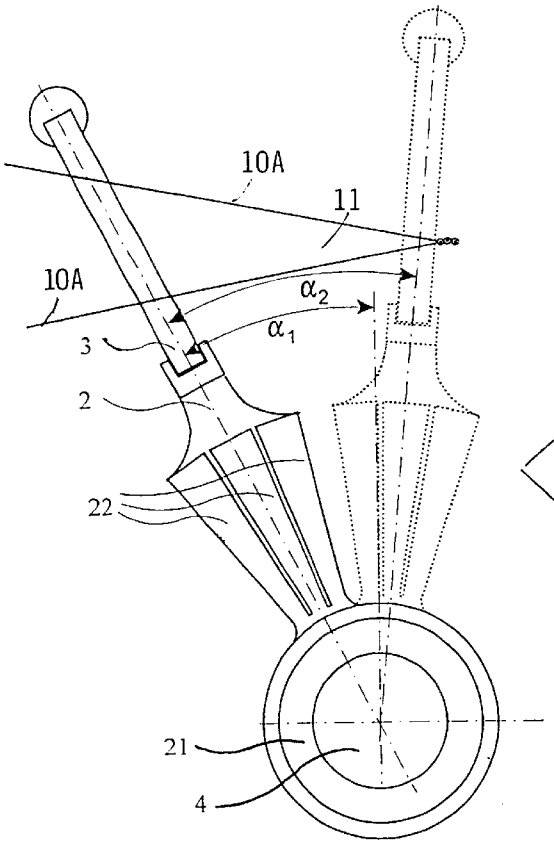
FIG. 6 shows the slay of FIG. 5 carrying secondary linear motor elements, for example permanent magnets.

FIG. 6 shows how the bearing 21 surrounds the reed support shaft 4. The bearing 21 may be a slide bearing or preferably an anti-friction bearing having an outer race to which the slay 2 carrying the reed 3 is rigidly secured while the shaft 4 is stationarily mounted in the loom frame. For example, three permanent magnets 22 are attached to the facing side of the slay 2.

Figure 7:
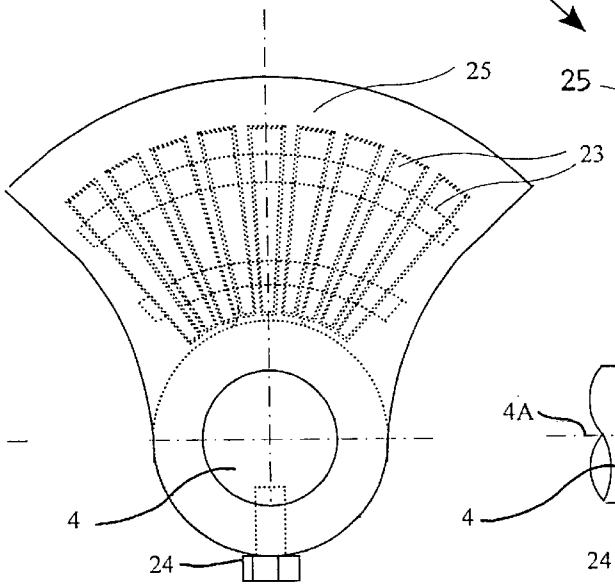
FIG. 7 is a fan-shaped mounting member of FIG. 5 carrying primary motor elements such as electromagnetic coils cooperating with the permanent magnets forming the secondary elements mounted to the slay.

FIG. 7 shows a face of the fan-shaped mounting member 25 to which the electromagnetic coils 23 are secured. The mounting member 25 is rigidly secured to the shaft 4 by screws 24.

Figure 8:
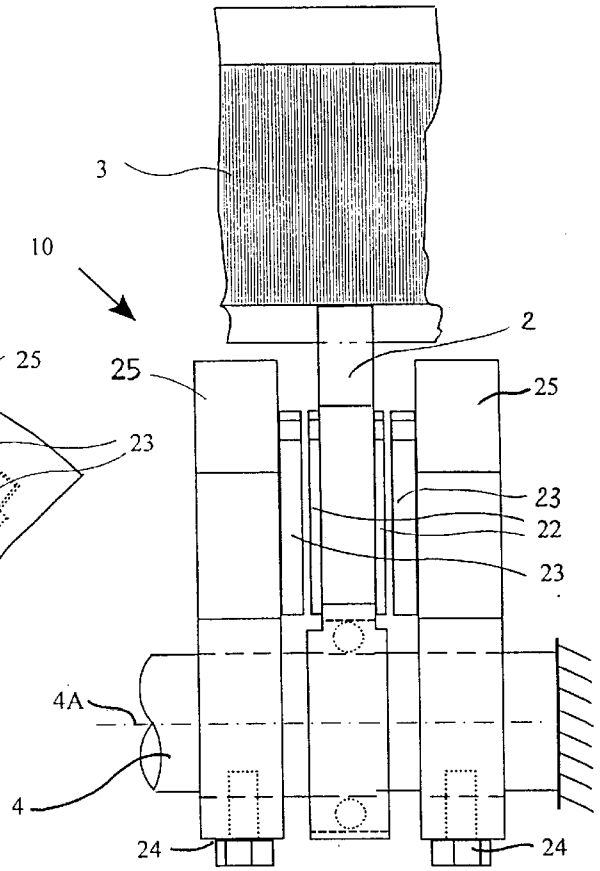
FIG. 8 is a view in the direction of the arrow VIII in FIG. 5 illustrating a double arrangement of secondary motor elements arranged on both axially facing surface segments of the slay and primary motor elements arranged on respective surface segments of the fan-shaped mounting member.

FIG. 8 shows a view in the direction of the arrow VIII in FIG. 5 illustrating a side view of the linear motor 10, wherein the reed slay 2 carries permanent magnet elements 22 on both axially facing sides. The slay 2 is rotatably mounted on the reed support shaft 4 for an oscillating tilting back and forth movement about the central longitudinal axis 4A of the rigidly mounted shaft 4 forming the stator of the motor. The slay 2 is positioned between two mounting members 25 carrying the coils 23 facing the respective magnets 22 on the slay 2. Both mounting members 25 are rigidly secured to the reed support shaft 4 by screws 24. The function of a linear motor is well known and hence does not require description in this context. However, it should be mentioned that the reed support shaft 4 could be rotatably mounted in the loom frame LF. In that case, the slay 2 would be rigidly secured to the shaft 4 while the mounting members 25 with the coils 23 are rigidly secured to the loom frame, for example in the manner shown in FIG. 2 by the mounting member 15.

The reversal of the motion direction of the direct reed drive motors 1 and 10 is accomplished by well known techniques. For example if the motors 1 and 10 are constructed as D.C. motors a simple polarity reversal of the drive voltage reverses the motion direction. Conventional inverters are used to reverse the motion direction of synchronous three-phase motors. Frequency converters are used to reverse the motion direction of asynchronous motors. Regardless of the type of motor used, each of the direct reed drive motors 1, 10 may be constructed as a modular unit so that all drives are identical to each other.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A reed drive for a loom comprising at least one reed slay (2) carrying a reed (3) in said loom, said reed drive comprising a reed support shaft (4), wherein said reed slay carrying said reed is operatively mounted on said reed support shaft (4), said reed drive further comprising a direct drive electromagnetic motor, wherein said reed support shaft (4) is a part of said direct drive electromagnetic motor for oscillating said reed (3) back and forth between a rear position and a forward weft beat-up position (13A).

2. The reed drive of claim 1, wherein said reed support shaft (4) is adapted to be rigidly mounted in a loom frame (LF), wherein at least a portion of said reed support shaft (4) forms an inner stator carrying first motor elements (5) of said direct drive electromagnetic motor, and wherein said reed slay (2) comprises a rotatable carrier (7) carrying second motor elements (6) forming an outer rotor, said rotatable carrier (7) extending at least partly around said inner stator formed by said reed support shaft (4).

3. The reed drive of claim 1, wherein said reed support shaft (4) is adapted to be rotatably mounted in a loom frame (LF) to form an inner rotor of said direct drive electromagnetic motor, second motor elements (6) carried by said rotor, wherein said at least one reed slay (2) of said reed (3) is rigidly mounted to said reed support shaft (4) forming said inner rotor, wherein said direct drive electromagnetic motor comprises a stator (8) carrying first motor elements (5), said stator extending around said inner rotor formed by said reed support shaft, and wherein said stator (8) comprises a mounting (15) adapted to be secured in a loom frame (LF) in a stationary position.

4. The reed drive of claim 1, wherein said direct drive electromagnetic motor is a reversible motor for said oscillating of said reed.

5. The reed drive of claim 1, comprising a plurality of said direct drive electromagnetic motors distributed along a weaving width of said loom.

6. The reed drive of claim 5, wherein each of said plurality of direct drive electromagnetic motors forms a modular drive unit.

7. The reed drive of claim 1, further comprising a sensor for sensing an instantaneous angular position of said reed.

8. The reed drive of claim 7, wherein said sensor is a synchro-resolver cooperating with said direct drive electromagnetic motor.

9. The reed drive of claim 1, comprising at least two of said direct drive motors, said reed support shaft forming part of each of said at least two direct drive motors, wherein one direct drive motor drives said reed through said reed slay in one direction, and wherein the other direct drive motor drives said reed through said reed slay in the opposite direction.

10. The reed drive of claim 1, wherein said direct drive electromagnetic motor comprises said reed support shaft (4) as a motor component and further including electromagnetic motor elements (22, 23) arranged angularly to form a linear motor of circular or partly circular configuration for said oscillating of said reed.

11. The reed drive of claim 10, wherein said reed support shaft (4) is adapted for rigid mounting in a loom frame (LF), wherein said at least one reed slay comprises secondary motor elements (22) of said linear motor, said linear motor (10) further comprising a support (25) and primary motor elements (23) secured to said mounting support in parallel to said secondary elements (22).

12. The reed drive of claim 11, wherein said support (25) is connected to said reed support shaft (4) for transmitting driving force.

13. The reed drive of claim 10, wherein said reed support shaft (4) is adapted to be rotatably mounted in a loom frame (LF) for rotation about a central longitudinal axis (4A), wherein said at least one reed slay (2) comprises primary motor elements (23) of said linear motor (10), wherein said at least one reed slay (2) is operatively mounted on said rotatable reed support shaft (4), said linear motor (10) further comprising a mounting support (25) and secondary motor elements (22) secured to said mounting support (25) in parallel to said primary motor elements.

14. The reed drive of claim 10, wherein said electromagnetic motor elements (22) are secured to said at least one reed slay.

15. The reed drive of claim 14, wherein said at least one reed slay comprises two opposite sides, and wherein said electromagnetic motor elements (22) are secured to each of said two opposite sides.

16. The reed drive of claim 15, wherein said electromagnetic motor elements are secondary motor elements and wherein a primary motor element (23) is allocated to each secondary motor element.

17. The reed drive of claim 10, wherein said linear motor is reversible in its driving direction.

18. The reed drive of claim 11, wherein said primary motor elements (23) and said secondary motor elements (22) together form a disc armature motor.

19. The reed drive of claim 10, comprising at least two of said linear motors, and wherein said reed support shaft forms part of each of said at least two of said linear motors, wherein one of said linear motors drives said reed (3) in one direction, and wherein the other linear drive motor drives said reed in the opposite direction.

20. The reed drive of claim 10, wherein said reed support shaft and said electromagnetic motor elements (22, 23) are arranged relative to each other in a circular configuration for converting linear motion components into an angular back and forth reed motion.

* * * * *